US005463196A

United States Patent [19]

Darimont

[11] Patent Number: 5,463,196

[45] Date of Patent: Oct. 31, 1995

[54] CAPTURED KEY ELECTRICAL SAFETY LOCKOUT SYSTEM

[75] Inventor: Daniel E. Darimont, Aurora, Ill.

[73] Assignee: Universities Research Association, Inc., Washington, D.C.

[21] Appl. No.: 48,986

[22] Filed: Apr. 16, 1993

[51] Int. Cl.[6] ..... H01H 9/28

[52] U.S. Cl. ..... 200/43.16; 200/43.14; 200/43.11

[58] Field of Search ..... 260/43.01, 43.02, 260/43.09, 43.11, 43.14, 43.15, 43.22, 43.16, 42.01; 70/DIG. 30, 282, 338, 339, 389, 428; 200/43.19, 333, 334

[56] References Cited

U.S. PATENT DOCUMENTS

| | | | |
|---|---|---|---|
| 1,303,825 | 5/1919 | Shaw | 70/DIG. 30 |
| 1,795,010 | 3/1931 | Conzelmann et al. | 200/43.11 |
| 2,213,232 | 9/1940 | Thompson | 200/43.22 |
| 2,524,696 | 10/1950 | Ellis | 70/339 |
| 2,806,099 | 9/1957 | Rexroad | 200/43.14 |
| 3,629,530 | 12/1971 | Fischer | 200/43.08 |
| 4,153,826 | 5/1979 | Reddy | 200/43.08 |
| 4,210,788 | 7/1980 | Stranczek | 200/43.14 |
| 4,264,792 | 4/1981 | Gillette | 200/43.08 |
| 4,440,994 | 4/1984 | Nat | 200/43.04 |
| 4,482,789 | 11/1984 | McVey | 200/43.02 |
| 4,695,684 | 9/1987 | Bochard et al. | 200/42.07 |
| 4,705,920 | 11/1987 | Sahrbacker | 200/43.04 |

*Primary Examiner*—Henry J. Recla
*Assistant Examiner*—David J. Walczak
*Attorney, Agent, or Firm*—McAndrews, Held & Malloy, Ltd.

[57] ABSTRACT

A safety lockout apparatus for an electrical circuit includes an electrical switch, a key, a lock and a blocking mechanism. The electrical switch is movable between an ON position at which the electrical circuit is energized and an OFF position at which the electrical circuit is deactivated. The lock is adapted to receive the key and is rotatable among a plurality of positions by the key. The key is only insertable and removable when the lock is at a preselected position. The lock is maintained in the preselected position when the key is removed from the lock. The blocking mechanism physically maintains the switch in its OFF position when the key is removed from the lock.

The blocking mechanism preferably includes a member driven by the lock between a first position at which the electrical switch is movable between its ON and OFF positions and a second position at which the member physically maintains the electrical switch in its OFF position. Advantageously, the driven member's second position corresponds to the preselected position at which the key can be removed from and inserted into the lock.

19 Claims, 3 Drawing Sheets

CAPTURED KEY ELECTRICAL SAFETY LOCKOUT SYSTEM

This invention was made with Government support under Contract No. DE-AC02-76CH03000, awarded by the United States Department of Energy. The Government has certain rights in the invention.

FIELD OF THE INVENTION

The present invention relates to a mechanism for limiting access to electrical equipment. More particularly, the present invention relates to a device for reducing the risk of accidental activation of an electrical circuit when the circuit is being accessed.

BACKGROUND OF THE INVENTION

In many applications it is desirable to limit physical access to electrical circuits and additionally to minimize the risk that the circuit is accidentally energized while it is being accessed. Accidental activation of an electrical circuit during servicing, for example, can result in death or physical injury to personnel as well as damage to expensive equipment.

Physical access to an electrical circuit, such as a power transformer, is typically controlled by enclosing the circuit in a cabinet or housing. Such cabinets often have access doors which can be locked with an integral lock or a padlock. In order to prevent continued activation of the circuit when the cabinet doors are opened, it is known to provide proximity switches for deactivating the circuit in response to the cabinet doors being opened. However, such safety systems can easily be circumvented by short circuiting the switch or biasing the switch to its closed position.

Additionally, it is known to provide devices for physically maintaining a main power switch or circuit breaker in its off position. Two such systems are disclosed in Nat U.S. Pat. No. 4,440,994, issued Apr. 3, 1984, and Sahrbacker U.S. Pat. No. 4,705,920, issued Nov. 10, 1987. The Nat patent describes a pivoted actuator switch having a lock to prevent the switch from being turned to the "on" position without insertion of a removable key member. The Sahrbacker patent describes a slidable electrical contact carrier actuated by a rocker type actuator which includes a removable locking key as a part of the actuator assembly. Removal of the key in the Sahrbacker device prevents movement of the carrier and thus prevents actuation of the switch. These devices suffer from at least two drawbacks. First, manufacture of these devices is complicated and costly because both patents incorporate specially manufactured locks and/or components. Second, neither system can readily be adapted to limit physical access to the electrical circuit.

It is an object of the present invention to provide a safety apparatus which controllably maintains an electrical power switch in its off position.

Another object of the present invention is to provide a safety apparatus which inhibits access to an electrical circuit when the circuit is deactivated.

A further object of the invention is to provide a safety lockout which is both simple and economical to manufacture.

Other objects and advantages of the invention will become apparent upon reading the following detailed description and appended claims, and upon reference to the accompanying drawings.

SUMMARY OF THE INVENTION

One aspect of the present invention is a safety lockout apparatus for an electrical circuit. The apparatus includes an electrical switch, a key, a lock and a blocking means. The electrical switch is movable between an ON position at which the electrical circuit is energized and an OFF position at which the electrical circuit is deactivated. The lock is adapted to receive the key and is rotatable among a plurality of positions by the key. The key can only be inserted and removed when the lock is at a preselected position. The lock is designed to remain in the preselected position when the key is removed from the lock. The blocking means physically maintains the switch in its OFF position when the key is removed from the lock.

The blocking means preferably includes a member driven by the lock between a first position at which the electrical switch is movable between its ON and OFF positions and a second position at which the member physically maintains the electrical switch in its OFF position. Advantageously, the driven member's second position corresponds to the preselected position at which the key can be removed from and inserted into the lock.

BRIEF DESCRIPTION OF THE DRAWINGS

For a more complete understanding of this invention reference should now be had to the embodiment illustrated in greater detail in the accompanying drawings and described below by way of example of the invention.

In the drawings.

DETAILED DESCRIPTION OF THE PREFERRED EMBODIMENTS

Figure 1:
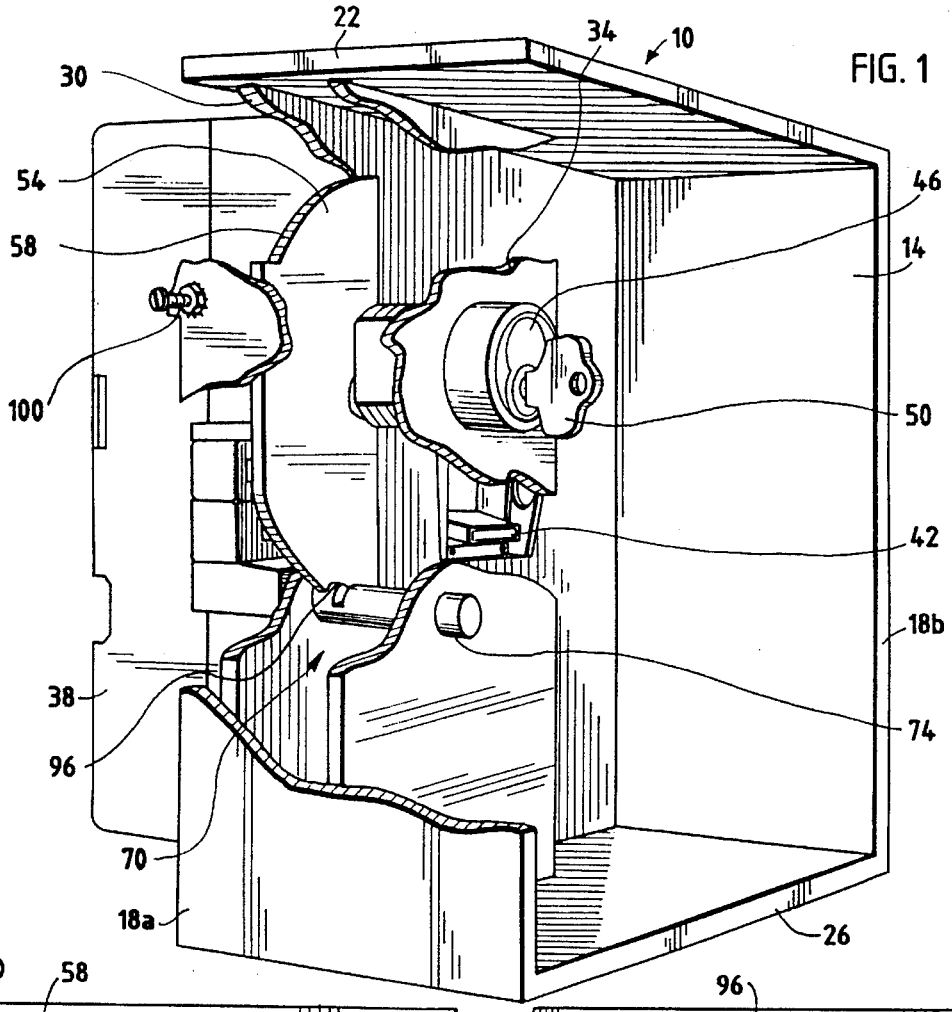
FIG. 1 is a fragmentary perspective view of an embodiment of the present invention.
Figure 2:
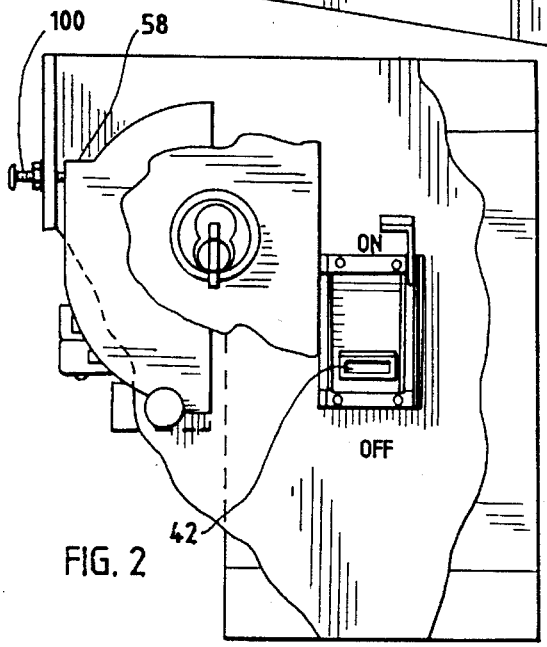
FIG. 2 is a fragmentary front elevation view of the present invention with the blocking member located at its first position.
Figure 3:
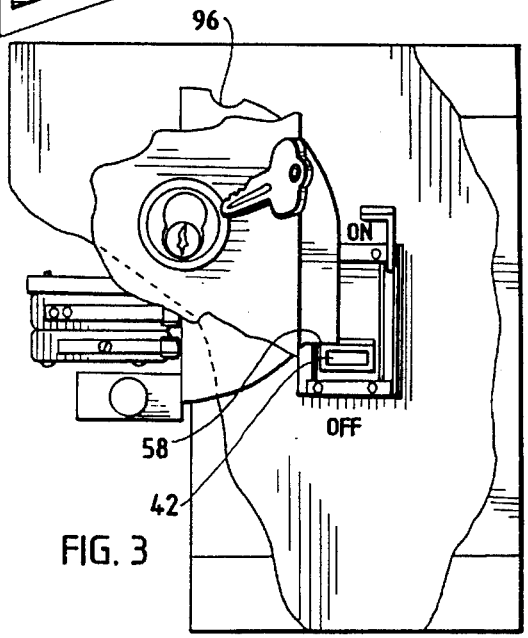
FIG. 3 is a fragmentary front elevation view of the present invention with the blocking member located at its second position.

Referring initially to FIGS. 1–3, a safety lockout apparatus 10 for an electrical circuit (not shown) is described. The safety lockout 10 includes a housing 14 having first and second opposing side plates 18*a*, 18*b*, a top plate 22, a bottom plate 26, a switch mounting plate 30, and a lock mounting plate 34. The housing 14 is preferably formed of an electrically nonconductive material such as an epoxy-fiberglass composite.

An electrical switch 38 or circuit breaker is mounted to the switch mounting plate 30. The switch controls the flow of electrical power from an external power source (not shown) to the electrical circuit. A control lever 42 of the electrical switch 38 extends through an aperture in the switch mounting plate 30. The control lever 42 is movable between an ON position at which the electrical circuit is energized and an OFF position at which the electrical circuit is deactivated.

A first key driven lock 46 is mounted in the lock mounting plate 34. The lock 46 is rotatable among a plurality of positions by a key 50. The key 50 can only be inserted and removed when the lock 46 is at a preselected position (see FIG. 3). This type of lock is commonly referred to as a "captured key" lock. A suitable captured key lock is a model 1W7D2606K as manufactured by the Best Lock Company of Indianapolis, Ind. The lock 46 is designed so that when the key 50 is removed from the lock 46, the lock 46 is maintained at the preselected position. A blocking means 54 physically maintains the switch 38 in its OFF position when the key 50 is removed from the lock 46. The blocking means 54 includes a blocking member 58 connected to and driven by the lock 46 between first and second positions. When the blocking member 58 is at its first position (see FIG. 2) the control lever 42 is movable between its ON and OFF positions. At its second position (see FIG. 3), the blocking member 58 physically maintains the control lever 42 in its OFF position. Advantageously, the blocking member's second position corresponds to the preselected position at which the key 50 can be removed from the lock 46. Hence, when the key 50 is removed from the lock 46, the lock 46 physically retains the blocking member 58 in its second position and prevents the control lever 42 from being moved to the ON position.

The blocking member 58 is illustrated as a cam which is rotatably driven by the lock 46. While this is the preferred embodiment, the blocking member 58 can readily take other configurations without departing from the scope of the invention. For example, the blocking member could be in the form of a lever or bar which is rotatably driven by the lock. Additionally, it is conceivable that the blocking member 58 could be linearly driven by the lock 46. For example, the lock 46 could be adapted to rotatably drive a toothed wheel or gear. This toothed wheel could in turn linearly drive a blocking member, such as a lever, having reciprocal teeth.

Figure 4:
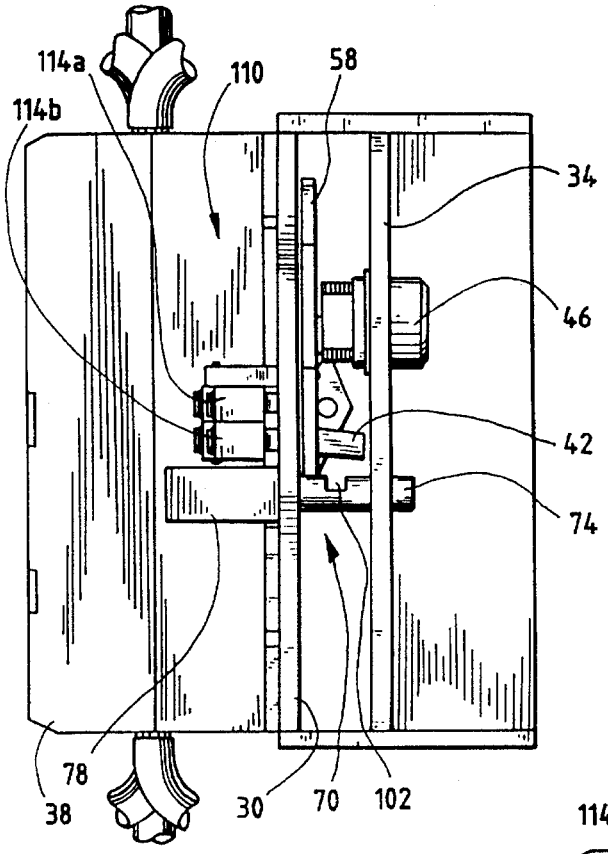
FIG. 4 is a side elevation view of the present invention illustrating the plunger mechanism at its first position.
Figure 5:
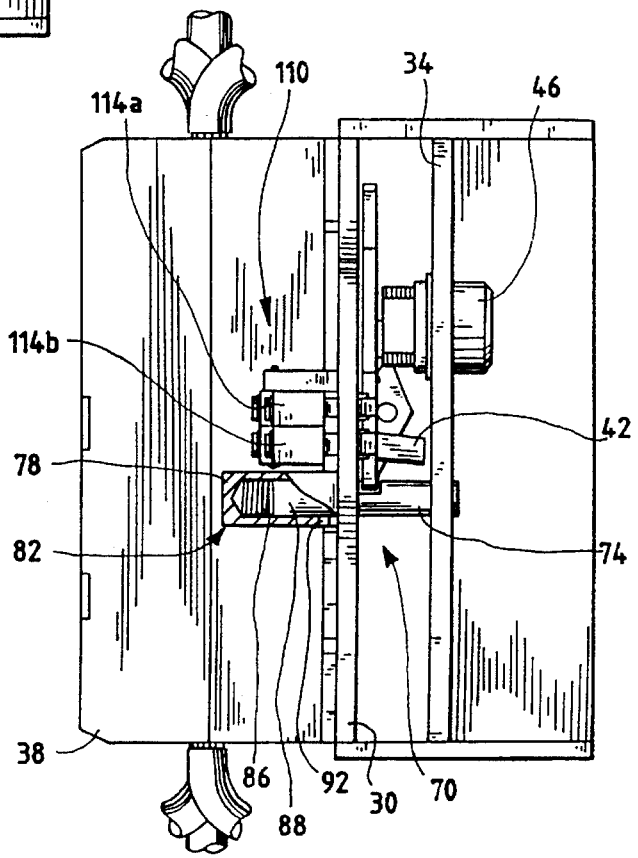
FIG. 5 is a side elevation view of the present invention illustrating the plunger mechanism at its second position.

Referring additionally to FIGS. 4 and 5, a locking means 70 is described. The locking means 70 is provided for locking the blocking member 58 in its first position. The locking means 70 includes a plunger 74 which extends through the switch plate 30 and the lock mounting plate 34. A mounting block 78 is provided for attaching the plunger 74 to the switch plate 30. The plunger 74 is movable between first and second positions in a direction substantially parallel to the axis of rotation of the blocking member 58. The plunger 74 is normally biased to its first position by a bias means 82 such as a spring 86 located in the bottom of the mounting block 78. A pin 88 extends through the plunger 74 perpendicular to the plunger's direction of travel. As the plunger moves between its first and second positions, the pin 88 travels through opposing slots 92 in the mounting block 78. The length of the slots corresponds to the length between the plunger's first and second positions. The combination of the pin 88 and slots 92 serve to retain the plunger 74 in the mounting block and limit the plunger's movement to positions between the first and second positions.

When the plunger 74 is at its first position it retains the blocking member 58 in its first position. More specifically, the blocking member 58 includes a reciprocal notch 96 which aligns with the plunger 74 when the blocking member 58 is at its first position. When the plunger 74 is in its second position, the blocking member 58 can be freely rotated by the lock 46. For this purpose the plunger 74 includes a slot 102 which permits rotation of the blocking member 58 when the plunger 74 is in its second position. The slot 102 is wider than the thickness of the blocking member 58 and is positioned on to align with the blocking member 58 when the plunger 74 is moved to its second position.

A set screw 100 is provided for ensuring that the reciprocal notch 96 aligns with the plunger 74. The set screw 100 also ensures that when the blocking member 58 is rotated counter clockwise, it does not travel past the first position.

While the illustrated configuration of the plunger 74 is the preferred embodiment, it should be appreciated that other embodiments could be used without departing from the scope of the present invention. For example, the plunger 74 could be positioned to extend through the first opposing side 18*a* for travel in a direction perpendicular to the plunger's axis.

A means 110 is provided for deactivating the electrical circuit in response to blocking member 58 being displaced from its first position by more than a preselected amount. The deactivating means 110 includes first and second microswitches 114*a*, 114*b*, each being movable between an ON position at which the electrical circuit is energized and an OFF position at which the electrical circuit is deactivated. The microswitches 114*a*, 114*b* are positioned to be biased OFF when the blocking member 58 is displaced from its first position by more than a preselected amount. The microswitches 114 are connected in series with the switch 38. If any of these switches is biased off, i.e. open, the electrical circuit is deactivated.

Figure 6:
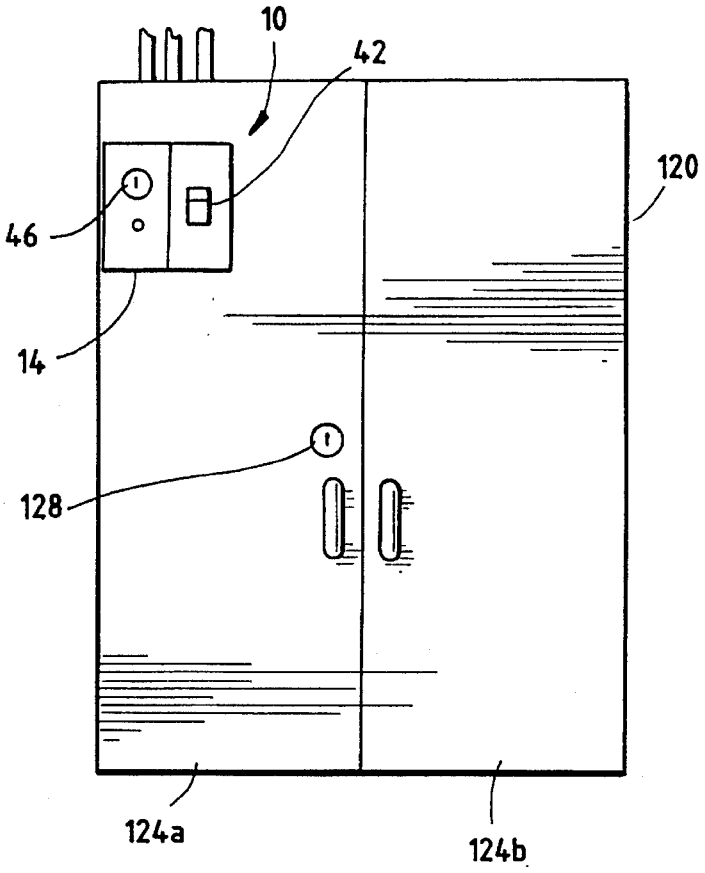
FIG. 6 is an elevation view of an electrical cabinet incorporating the present invention.
Figure 7:
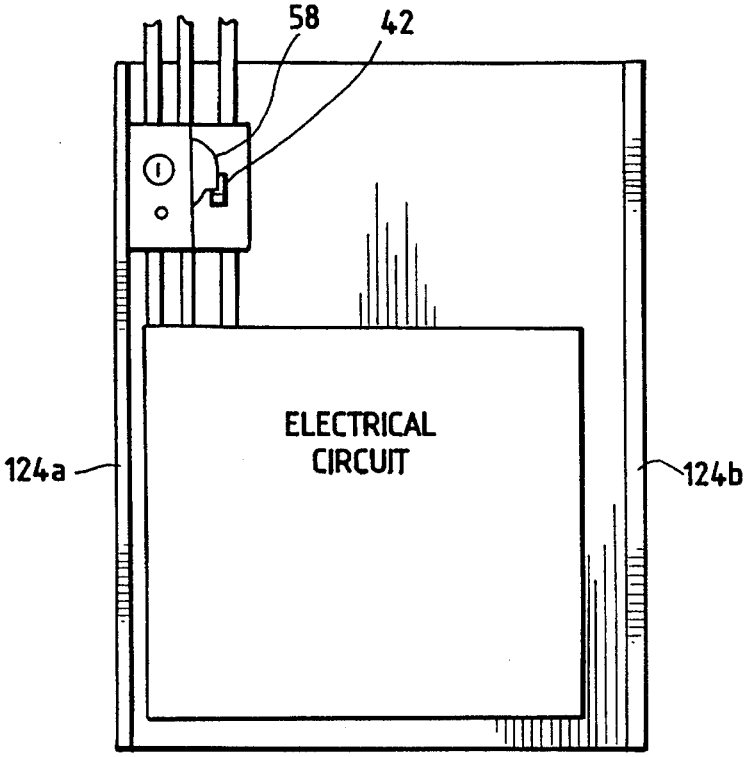
FIG. 7 is an elevation view of an electrical cabinet incorporating the present invention.

As is illustrated in FIG. 6 and 7, the safety lockout apparatus 10 is designed so that the entire housing 14 can be mounted in a cabinet 120 used to house the electrical circuit. A typical cabinet includes at least one door movable between open position where the electrical circuit is accessible and a closed position where the circuit is not accessible. Preferably, the cabinet 120 includes a first cabinet door 124*a* and a second cabinet door 124*b*, as illustrated in FIGS. 6 and 7. The first cabinet door 124*a* is provided with a second key driven lock 128 which is identical to the first key driven lock 46. The second lock 128 is movable between a first position at which the doors 124*a*, 124*b* are locked in their closed positions and a second position at which the doors 124*a*, 124*b* can be opened. This second lock 128 is also a captured key lock and is installed so that the key can only be removed when the lock is at its first position. Advantageously, the same key 50 must be used to operate the first and second locks 46, 128. Hence, the cabinet doors 124*a*, 124*b* can only be opened when the blocking member 58 is in its second position and control lever 42 is in its off position.

It is to be understood that the present invention is only designed to preventing accidental activation of the electrical circuit while it is being accessed. Like most safety systems, the present invention is not effective against deliberate circumvention.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A safety lockout apparatus for an electrical circuit comprising:

an electrical switch movable between an ON position at which the electrical circuit is energized and an OFF position at which the electrical circuit is deenergized;

a key;

a lock being adapted to receive said key, said lock being rotatable among a plurality of positions by said key, said key only being insertable and removable when said lock is at a preselected position, said lock being maintained in said preselected position when said key is removed from said lock;

a blocking member driven by said lock between a first position at which said electrical switch is movable between its ON and OFF positions and a second position at which said blocking member physically maintains said electrical switch in its OFF position, whereby said blocking member second position corresponds to said preselected position at which said key can be removed from and inserted into said lock;

a plunger movable between a first position at which said plunger engages said blocking member and maintains said blocking member in its first position and a second position at which said plunger is disengaged from said blocking member to permit movement of said blocking member; and bias means for normally biasing said plunger to its first position.

2. The apparatus of claim 1 wherein said bias means comprises a spring.

3. The apparatus of claim 2 wherein said housing is formed of a non-conductive material.

4. The apparatus of in claim 3 wherein said housing is formed from an epoxy and fiberglass composite.

5. The apparatus of claim 3 wherein said blocking member is rotatably driven by said lock between said first and second positions.

6. The apparatus of claim 5 wherein said plunger is movable between its first and second positions in a direction substantially parallel to the axis of rotation of said member.

7. The apparatus of in claim 6 wherein said member includes a reciprocal grove which is adapted to fixedly engage said plunger when said blocking member is in its first position, thereby maintaining said blocking member at its first position.

8. The apparatus of claim 1 further comprising;

a cabinet adapted to contain the electrical circuit;

a cabinet cover movable between an open position where the circuit is accessible and a closed position where the circuit is not accessible; and a second lock adapted receive said key and being movable by said key between a first position at which said cover is locked in its closed position and a second position at which said cover can be opened, said key only being insertable and removable when said lock is at its first position.

9. The apparatus of in claim 1 further comprising means for deactivating the electrical circuit in response to said blocking member being displaced from its first position by more than a preselected amount.

10. The apparatus of claim 9 wherein said deactivating means comprises a second electrical switch movable between an ON position at which the electrical circuit is energized and an OFF position at which the electrical circuit is deactivated, said second switch being biased to its OFF position when said member is displaced from its first position by more than a preselected amount.

11. A safety lockout apparatus for an electrical circuit comprising:

a nonconductive housing;

an electrical switch mounted in said housing and being movable between an ON position where the electrical circuit is energized and an OFF position where the electrical circuit is deenergized;

a key;

a key actuated lock mounted in said housing and being adapted to receive said key, said lock being rotatably driven among a plurality of positions by said key, said key being insertable and removable only when said lock is at a preselected position, said lock being maintained at said preselected position when said key is removed from said lock;

a blocking member mounted in said housing and driven by said lock between a first position at which said electrical switch is movable between its ON and OFF positions and a second position at which said blocking member physically maintains said electrical switch in its OFF position, whereby said blocking member second position corresponds to said preselected position at which said key can be removed from and inserted into said lock; and a plunger mounted in said housing and being movable between a first position at which said plunger engages said blocking member and maintains said blocking member at its first position and a second position at which said blocking member is disengaged from said blocking member to permit movement of said blocking member.

12. A safety lockout apparatus for an electrical circuit comprising:

a nonconductive housing;

an electrical switch mounted in said housing and being movable between an ON position where electrical circuit is energized and an OFF position where the electrical circuit is deenergized;

a key;

a key actuated lock mounted in said housing and being adapted to receive said key, said lock being rotatable among a plurality of positions by said key, said key being insertable and removable only when said lock is at a preselected position, said lock being maintained at said preselected position when said key is removed from said lock;

a blocking member rotatably driven by said lock between a first position at which said electrical switch is movable between its ON and OFF positions and a second position at which said blocking member physically maintains said electrical switch in its OFF position, whereby said blocking member second position corresponds to said preselected position at which said key can be removed from and inserted into said lock;

a plunger mounted in said housing and being movable between first position at which said plunger engages said blocking member and maintains said blocking member at its first position and a second position at which said plunger is disengaged from said blocking member to permit movement of said blocking member, said plunger being movable in a direction substantially parallel to the axis of rotation of said blocking member.

13. The apparatus of claim 12 wherein said member includes a reciprocal grove which is adapted to fixedly engage said plunger when said blocking member is in its first position, thereby maintaining said blocking member at its first position.

14. The apparatus of claim 13 wherein plunger includes a slot which is adapted to permit rotation of said blocking member when said plunger is in its second position.

15. The apparatus of claim 14 further comprising means for normally biasing said plunger to its first position.

16. The apparatus of claim 15 wherein said bias means includes a spring.

17. A safety lockout apparatus for an electrical circuit comprising:

a nonconductive housing;

an electrical switch mounted in said housing and being movable between an ON position where electrical circuit is energized and an OFF position where the electrical circuit is deenergized;

a key;

a key actuated lock mounted in said housing and being adapted to receive said key, said lock being rotatable among a plurality of positions by said key, said key being insertable and removable only when said lock is at a preselected position, said lock being maintained at said preselected position when said key is removed from said lock; and a blocking member rotatably driven by said lock between a first position at which said electrical switch is movable between its ON and OFF positions and a second position at which said blocking member physically maintains said electrical switch in its OFF position, whereby said blocking member second position corresponds to said preselected position at which said key can be removed from and inserted into said lock;

a cabinet adapted to contain the electrical circuit;

a cabinet cover movable between an open position where the circuit is accessible and a closed position where the circuit is not accessible; and a second key actuated lock adapted receive said key and being movable by said key between a first position at which said cover is locked in its closed position and a second position at which said cover can be opened, said key only being insertable and removable when said lock when said lock is at its first position.

18. The apparatus of claim 17 further comprising means for deactivating the electrical circuit in response to blocking member being displaced from its first position by more than a preselected amount.

19. The apparatus of claim 18 wherein said deactivating means comprises a second power supply switch movable between an ON position at which the electrical circuit is energized and an OFF position at which the electrical circuit is deactivated, said switch being biased to its OFF position when said blocking member is displaced from its first position by more than a preselected amount.

* * * * *